US005689141A

United States Patent [19]

Kikkawa et al.

[11] Patent Number: 5,689,141

[45] Date of Patent: Nov. 18, 1997

[54] COMPRESSOR DRIVE SYSTEM FOR A NATURAL GAS LIQUEFACTION PLANT HAVING AN ELECTRIC MOTOR GENERATOR TO FEED EXCESS POWER TO THE MAIN POWER SOURCE

[75] Inventors: Yoshitsugi Kikkawa; Osamu Yamamoto; Yasuhiro Naito; Junichi Sakaguchi, all of Kanagawa-ken, Japan

[73] Assignee: Chiyoda Corporation, Japan

[21] Appl. No.: 458,322

[22] Filed: Jun. 6, 1995

[30] Foreign Application Priority Data

Feb. 14, 1995 [JP] Japan ..... 7-048994

[51] Int. Cl.[6] ..... F25B 11/02; F25J 3/00; F02C 6/00

[52] U.S. Cl. ..... 290/52; 290/1 R; 62/613

[58] Field of Search ..... 62/611, 612, 613; 290/52, 1 R

[56] References Cited

U.S. PATENT DOCUMENTS

| | | | |
|---|---|---|---|
| 3,764,815 | 10/1973 | Habock et al. | 290/52 |
| 4,036,028 | 7/1977 | Mandrin | 62/50.3 |
| 4,069,424 | 1/1978 | Burkett | 307/87 |
| 4,093,869 | 6/1978 | Hoffmann et al. | 290/31 |
| 4,359,871 | 11/1982 | Stass | 48/127.3 |
| 4,566,885 | 1/1986 | Haak | 62/613 |
| 5,365,740 | 11/1994 | Kikkawa et al. | 62/613 |

*Primary Examiner*—Steven L. Stephan
*Assistant Examiner*—Christopher Cuneo
*Attorney, Agent, or Firm*—Lorusso & Loud

[57] ABSTRACT

In a compressor drive system for a natural gas liquefaction plant including a plurality of gas turbines each provided in an individual refrigeration cycle for pressurizing a different refrigerant, an electric motor is provided for each of the gas turbines so as to serve both as an auxiliary electric motor for generating a startup torque and as an AC generator, and the excess output power of the gas turbine is converted into electric power by this electric motor when the power requirement of the associated compressor is less than the power output of the gas turbine. Additionally, at least two of the gas turbines are of an identical make which is suitable for driving the compressor of one of the associated refrigeration cycles requiring a larger driving power. Therefore, the gas turbines can be operated at optimum conditions at all times without regard to seasonal changes of the operating conditions, and the efficient operation of the gas turbines will result in a significant reduction in the operation costs through a substantial saving of fuel consumption. Moreover, any excess power output of one of the gas turbines can be allocated so as to reduce the burden of the in-plant power station and/or to supplement the shortage of the power output of the other gas turbine, and the management of the stand-by units and spare parts can be simplified. These factors have a compounded effect in reducing the investment costs of the plant.

4 Claims, 2 Drawing Sheets

COMPRESSOR DRIVE SYSTEM FOR A NATURAL GAS LIQUEFACTION PLANT HAVING AN ELECTRIC MOTOR GENERATOR TO FEED EXCESS POWER TO THE MAIN POWER SOURCE

TECHNICAL FIELD

The present invention relates to a compressor drive system for pressurizing a refrigerant for cooling natural gas in a natural gas liquefaction plant.

BACKGROUND OF THE INVENTION

In a natural gas liquefaction plant for purifying and liquefying natural gas produced from a gas well, the necessary energy is generated by using natural gas, and supplied in two forms, thermal energy and kinetic energy. The thermal energy is produced by boilers and furnaces, and the kinetic energy is produced primarily by gas turbines.

A primary user of the kinetic energy is the compressors for pressurizing refrigerants for cooling natural gas. To minimize the consumption of energy in operating the compressors, the purified natural gas is cooled in two stages. More specifically, a propane refrigerant is used for preliminary cooling of the natural gas to a temperature of approximately −30° C., and a mixed refrigerant is used for cooling the natural gas below the natural gas liquefaction temperature of −162° C. Each of these refrigerants is circulated in an independent closed loop forming an individual refrigeration cycle. A dedicated gas turbine is installed in each of these refrigeration cycles to drive the corresponding compressor.

Another major user of the kinetic energy is the in-plant power station which is normally powered by a dedicated gas turbine in a similar manner as the compressors. The in-plant power station supplies electric power to drive the motors for pumps, small compressors, blowers, and other auxiliary equipment and supplied to other users of electric power within the plant. Thus, a natural gas liquefaction plant is normally provided with at least three gas turbines, two of them for pressurizing refrigerants, the remaining one for driving an in-plant power generator.

A natural gas liquefaction plant is normally extremely large in capacity so as to be capable of processing a large volume of natural gas, and the overall energy consumption of the plant is therefore enormous. Accordingly, the operation cost and the investment cost for the facilities for supplying energy to such a plant are substantial. In particular, because the gas turbines for driving the compressors for refrigerants are large in size, and highly expensive, they account for a substantial portion of the overall cost of operating and constructing the natural gas liquefaction plant. Furthermore, the manufacturers capable of manufacturing gas turbines of this class are very few in number worldwide, and the gas turbines are available only in specific sizes and limited specifications for each of the manufacturers. Thus, typically, the maximum available sizes of the gas turbines for driving the compressors dictate the maximum capacity of the refrigeration facilities composed of compressors, condensers and other components, and serve as a de facto deciding factor in determining the production capacity of the natural gas liquefaction plant.

Now, in such refrigeration cycles using propane refrigerants and mixed refrigerants, because sea water and ambient air are used for condensing pressurized refrigerants, the power requirement for driving the compressors changes substantially according to the seasonal changes in the sea water temperature and the ambient temperature. Furthermore, the power output of a gas turbine changes substantially depending on the change in the temperature of the intake air, and is therefore subject to significant seasonal changes. Therefore, it is a general practice in designing a plant of this kind to set the maximum capacities of the compressors and the gas turbines to those required or available at the time of the highest temperature during summer to be on the safe side. As a result, during the spring, fall and winter seasons when the water temperature and the ambient temperature are lower, the power requirement of the compressors drop while the power output of the gas turbines increases with the net result that the gas turbines will have an excess capacity for the given maximum processing capacity of the plant at that time, and will be placed under a reduced load condition even though the throughput of the plant remains the same. A gas turbine is normally designed so as to be most efficient when it is operated at its rated maximum power output, and its efficiency significantly drops when it is operated at such a partial load condition. Therefore, when the gas turbine is operated under a partial load condition, there will be a substantial waste in the fuel consumption, and the operation cost will increase.

Furthermore, to the end of ensuring a stable supply of liquefied natural gas, a stand-by unit is normally prepared for each of the rotating machines such as pumps and compressors so that even when any one of the rotating machines should fail the plant can be restarted quickly simply by switching valves. Stand-by units are also prepared for the generator for the in-plant power station, and the gas turbine for driving the power generator. However, because the compressors for pressurizing the refrigerants and the gas turbines for driving them are so large in size and expensive that it is economically impractical to keep a full set of stand-by units. Normally, spare parts only for the major components are prepared and kept in a warehouse, such as rotors and bearings, so as to minimize the time period of shut-down, and reduce the investment cost. However, the cost for the spare parts and the facilities for storing them is still a major factor in the investment cost of a natural gas liquefaction plant.

BRIEF SUMMARY OF THE INVENTION

In view of such problems of the prior art, a primary object of the present invention is to provide a compressor drive system for a natural gas liquefaction plant which can reduce the costs for operating and constructing the plant.

A second object of the present invention is to provide a compressor drive system for a natural gas liquefaction plant which allows the gas turbines to be operate at optimum conditions without regard to seasonal changes of the operating conditions.

A third object of the present invention is to provide a compressor drive system for a natural gas liquefaction plant which can reduce the burden on the in-plant electric power generator.

A fourth object of the present invention is to provide a compressor drive system for a natural gas liquefaction plant which can reduce the cost for stand-by units and spare parts for back-up purpose.

These and other objects of the present invention can be accomplished by providing a compressor drive system for a natural gas liquefaction plant including a plurality of gas turbines, each of the gas turbines being installed in a corresponding one of a plurality of refrigeration cycles each using a refrigerant of a different composition circulating in an independent closed loop, and adapted to drive a compressor for pressurizing the corresponding refrigerant, wherein: an electric motor is provided to each of the gas turbines so as to serve both as an auxiliary motor for generating a startup torque and an AC generator, the electric motor converting any excess power output of the corresponding gas turbine into electric power when electric power produced from the gas turbine is greater than a power required by the associated compressor.

Therefore, any excess power produced from any one of the gas turbines can be allocated for useful purpose so that the burden on the in-plant power generator can be reduced, and any shortage of power output from the other gas turbine can be supplemented with this excess power. Thus, the efficient utilization of power reduces the overall cost of the plant.

Preferably, at least two of the gas turbines consist of gas turbines of an identical make, and have a capacity sufficient for driving the compressor for one of the two associated refrigeration cycles having a greater power requirement. Thus, the spare parts such as rotors and bearings are needed only for one gas turbine, instead of keeping spare parts for two gas turbines, the cost required for the spare parts can be significantly reduced.

Additionally, the electric motors are preferably adapted to be directly connected to a main power line by power branch lines which allow a frequency converter for startup to be bypassed.

According to one aspect of the present invention, there is provided a compressor drive system for a natural gas liquefaction plant including at least a first compressor and a second compressor to be driven, comprising: a first gas turbine and a second gas turbine for driving the first and second compressors, respectively; a first electric motor and a second electric motor connected to output shafts of the first gas turbine and the second gas turbine, respectively, each of the electric motors being capable of serving also as electric generators; first and second switch means for electrically connecting the first and second electric motors to a main electric power line, respectively, in a selective fashion; a frequency converter which can be connected between each one of the electric motors and the main electric power line in a selective fashion via third and fourth switch means, respectively; and a synchronous signal detector for synchronizing the electric motor to a prevailing phase and frequency condition of the main electric power line.

By thus forming the compressor drive system for a natural gas liquefaction plant, and effectively utilizing the excess power output produced by the gas turbine, the gas turbine can be operated at its maximum output or at its maximum efficiency at all times, and the operation cost thereof can be reduced by reducing the fuel consumption. For instance, because the gas turbine which is optimally designed for the summer season can be operated substantially at its maximum efficiency all the year round, the fuel consumption in pressurizing refrigerants and generating electric power can be reduced accordingly. In particular, in the above mentioned propane refrigerant cycle, during the spring, fall and winter seasons, the power output from the gas turbine increases due to the drop in the ambient air temperature while the power requirement of the compressor decreases due to the drop in the temperature of the sea water for cooling. Furthermore, the decrease in the initial temperature of the natural gas produces an excess in the power output of the gas turbine, and using the excess power for generating electric power is highly advantageous in terms of fuel economy in view of the fact that the efficiency of the gas turbine drops in a partial load condition. The power consumption of the mixed refrigerant cycle is not affected by changes in the ambient temperature because the refrigerant is condensed by the propane cycle, but it is still possible to utilize an excess power output of the gas turbine that is produced during the spring, fall and winter seasons, due to a decrease in the temperature of the intake air of the gas turbine, for useful purpose.

Furthermore, by using gas turbines of an identical make for at least two of the gas turbines, and utilizing the resulting excess power output for generating electric power, it becomes possible to use the rotor and other major component parts for back-up purpose commonly for the two gas turbines thereby reducing the cost for preparing spare parts, and the necessary capacity of the in-plant power station can be substantially reduced. For instance, in a natural gas liquefaction plant including two refrigeration cycles, when gas turbines of a same capacity are used for the mixed refrigerant cycle and the propane medium cycle involving the use of a compressor of a relatively small capacity, a substantial excess is produced in the power output of the gas turbine for the propane refrigerant cycle. If this excess power output is converted into electric power with an electric motor serving also as an AC power generator, and the produced electric power is supplied to the electric facilities of the plant, the capacity of the in-plant power station can be significantly reduced. Because the power requirement of the mixed refrigerant cycle is greater than that of the propane refrigerant cycle by the factor or 1.5 to 2, the electric power produced from the excess power of the propane refrigerant cycle can suffice all of the need in the plant during steady state operation, and the in-plant power station is only required to have the capacity necessary for starting up the plant. Furthermore, because the in-plant power station is required to be operated only for a short time period for starting up the plant, no stand-by unit is necessary for the in-plant power station. In view of the fact that a stand-by unit is normally necessary for an in-plant power station, the reduction in the capacity requirement of the in-plant power station has a compounded effect in reducing the investment cost of the plant.

Additionally, if the electric power produced by the electric motor driven by the gas turbine along with the compressor is allowed to be directly supplied to the main power line without any intervention of the frequency converter for startup while the rotational speed of the electric motor in steady state condition is kept matched with the frequency of the in-plant power generator, the use of the highly expensive frequency converter can be limited only to the time of starting up the gas turbine with the motor, and the need for a stand-by frequency converter can be eliminated, thereby reducing the investment cost of the plant. This frequency converter is required when supplying electric power of a variable frequency to the electric motor which rotates with the gas turbine, and is therefore interposed between the main power line from the in-plant power station and the electric motor.

When the system is designed such that the excess power of the gas turbine may be converted into electric power with the electric motor, by supplementing any insufficiency of the power output from the gas turbine by supplying electric power to the electric motor during an operating condition involving any insufficiency of gas turbine power output, it becomes possible to flexibly cope with the seasonal changes in the power requirement of the compressor and the power output of the gas turbine, and the freedom in designing the plant can be increased. As mentioned above, the production capacity of a natural gas liquefaction plant is limited by the capacity of the refrigeration unit which is in turn determined by the maximum power output of the gas turbine used for driving the compressor, and is normally designed according to the conditions existing during the summer season. Therefore, by operating the plant so as to supplement the insufficiency of power output as described above during the summer season, it is possible to increase the maximum production capacity of the liquefaction plant to the level available in the spring and fall seasons by using the same gas turbine.

However, to accomplish this goal, the capacity of the in-plant power station would have to be increased by the amount required for the electric power that is to be supplied to the electric motor. Therefore, gas turbines of an identical make are used for the two gas turbines of the two refrigeration cycles so that one of the gas turbines may be capable of producing some excess power output while the other gas turbine may produce an insufficient power output, it is possible to convert the resulting excess power of one of the gas turbines into electric power, and supplement the insufficiency of the power output of the other gas turbine with the thus produced electric power with the result that the need for increasing the capacity of the in-plant power station can be eliminated.

Furthermore, when insufficiency in the power output of the gas turbine is supplemented by supplying electric power to the electric motor, by arranging such that the electric power may be supplied to the electric motor without the intervention of the frequency converter for startup, the need for a stand-by frequency converter can be eliminated, and the investment cost of the plant can be reduced.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
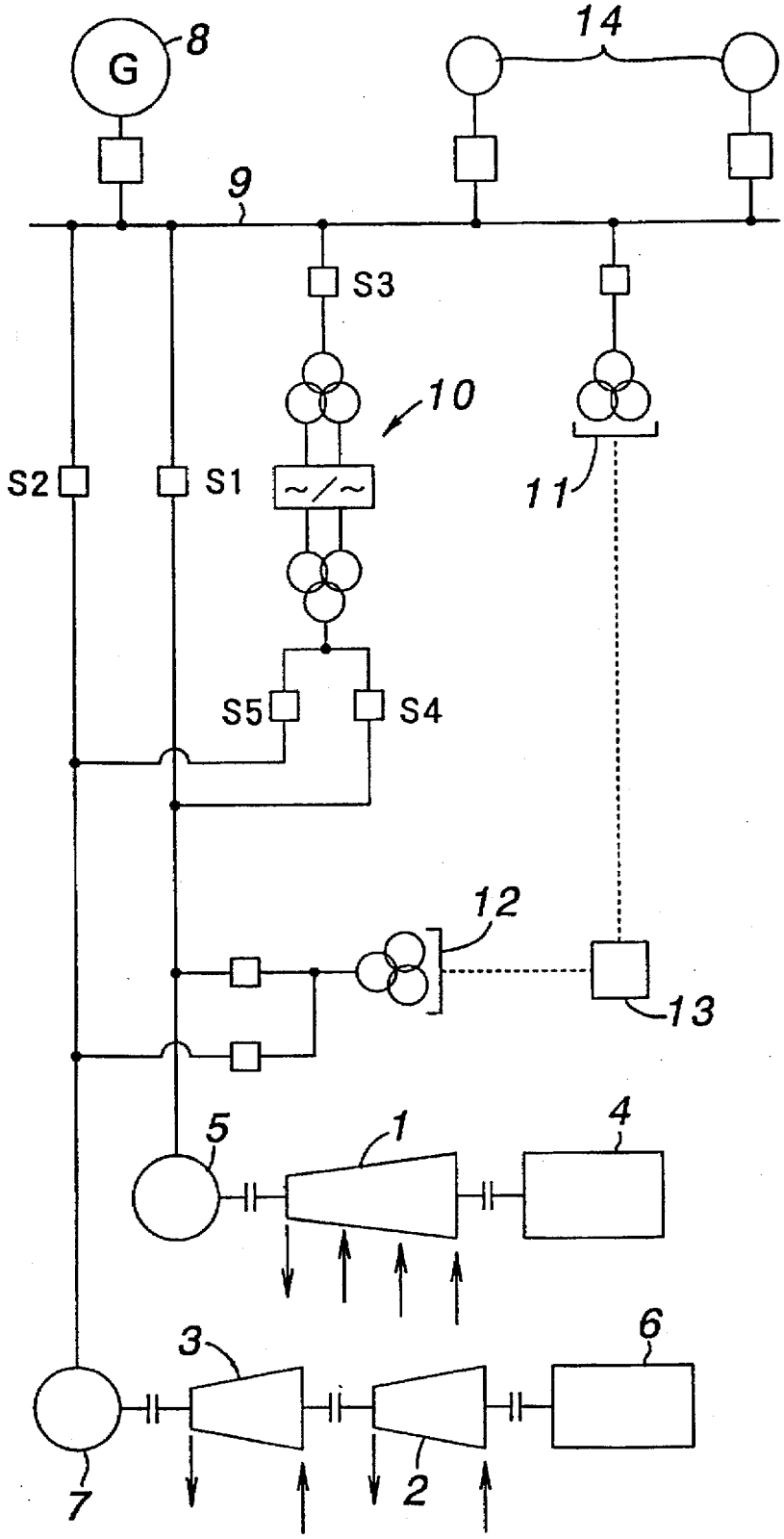
FIG. 1 is a block diagram generally showing the structure of a compressor drive system for a natural gas liquefaction plant to which the present invention is applied.

FIG. 1 generally illustrates a compressor drive system for a natural gas liquefaction plant to which the present invention is applied. This compressor drive system is designed to drive a propane compressor 1 and a pair of serially connected mixed refrigerant compressors 2 and 3 for pressurizing two different refrigerants (having different compositions) each circulating in an independent dosed loop. The propane compressor 1 is connected to a gas turbine 4 and a synchronous motor 5, and the mixed refrigerant compressors 2 and 3 are connected to a gas turbine 6 and a synchronous motor 7.

The propane compressor 1 pressurizes propane which serves as the refrigerant for a first refrigeration loop as described hereinafter, and is driven by the single-shaft gas turbine 4. The mixed refrigerant compressors 2 and 3 pressurize a mixed refrigerant, consisting of a mixture of nitrogen, methane, ethane and propane, serving as the refrigerant for a second refrigeration loop, in two stages. These mixed refrigerant compressors 2 and 3 are jointly driven by the common gas turbine 6.

The synchronous motors 5 and 7 are directly connected to a main power line 9 via switches S1 and S2, and are connected the main power line 9 also via a frequency converter 10, a switch S3 connected to the input end of the frequency converter 10, and switches S4 and S5 connected to the output end of the frequency converter 10. These synchronous motors 5 and 7 are used also as AC generators. Synchronous signal power sources 11 and 12 are provided for detecting the phase conditions of the power line 9 and the synchronous motors 5 and 7, and output lines from these synchronous signal power sources 11 and 12 are connected to a synchronous signal detector 13.

In this compressor drive system, when starting up the propane compressor 1, while the switches S1, S2 and S5 are kept open, the switches S3 and S4 are dosed. The synchronous motor 5 is synchronized in a low frequency range by tuning the frequency converter 10, and the frequency is progressively increased in synchronism with the corresponding increase in the rotational speed of the propane compressor 1 and the gas turbine 4. The electric power generated by the in-plant power station 8 is supplied to the synchronous motor 5 via the main power line 9 and the frequency converter 10, and the output torque produced by the synchronous motor 5 supplements the output torque of the gas turbine 4 during the startup until the gas turbine 4 is smoothly accelerated to the rotational speed from which the gas turbine 4 can accelerate itself.

Once the rotational speed of the gas turbine 4 reaches the speed level from which the gas turbine 4 can accelerate itself without the aid of the synchronous motor 5, the switches S3 and S4 are opened to shut down the supply of electric power to the synchronous motor 5. Then, the gas turbine 4 is accelerated to a prescribed rotational speed of the propane compressor 1. A similar startup procedure is also carried out for the mixed refrigerant compressors 2 and 3.

When the gas turbine 4 has thus reached the prescribed rotational speed, and the propane compressor 1 has been brought into a steady-state operating condition, the synchronous motor 5 is driven by the gas turbine 4 jointly with the propane compressor 1. The phase condition of this freely rotating synchronous motor 5 is transmitted from the synchronous signal power source 12 to the synchronous signal detector 13. The gas turbine 4 is finely adjusted until the phase condition of the synchronous motor 5 matches with the phase condition of the main power line 9, and, then, the switch S1 is closed so as to directly connect the synchronous motor 5 to the main electric power line 9. As a result, the power consumed by electric facilities 14, such as electric motors for driving pumps, small compressors, blowers and other auxiliary equipment, connected to the main power line 9 is supplemented by the synchronous motor 5 which can convert any excess power produced by the gas turbine 4 into electric power. Thus, the gas turbine 4 is allowed to operate at a full output condition or, in other words, at a high efficiency operating condition while the burden of the in-plant power station 8 is substantially reduced. When there is any excess in the power produced by the gas turbine 6 for the mixed refrigerant compressor 2 and 3, it can be also converted into electric power by the synchronous motor 7 in a similar fashion.

When the synchronous motor 5 is thus directly connected to the main power line 9, the rotational speed thereof is maintained at a fixed level according to the frequency of the power which is maintained by the in-plant power station 8. Therefore, even when a tendency arises to lower the rotational speed of the propane compressor 1 due to the insufficiency of power output from the gas turbine 4, electric power is supplied from the main power line 9 to the synchronous motor 5 so as to maintain the rotational speed thereof according to the frequency condition prevailing in the main power line 9, and the rotational speed of the propane compressor 1 is maintained at a fixed level by virtue of the supplemental torque produced by the synchronous motor 5.

A possible case of insufficient power output from the gas turbine 4 can arise during summer when the power requirement of the propane compressor 1 increases due to a rise in the temperature of the sea water for cooling and the power output from the gas turbine 4 decreases due to the rise in the ambient temperature because the propane compressor 1 and the gas turbine 4 are designed for the spring and fall seasons.

Thus, any insufficiency of torque output from the gas turbine 4 can be appropriately supplemented not only at the time of startup but also during steady state operation, and the increase in the power requirement of the compressor 1 and the decrease in the power output of the gas turbine 4 can be accommodated in a flexible fashion. The same arrangement can be made with the gas turbine 6 and the synchronous motor 7 for the mixed cooling compressors 2 and 3, and any insufficiency of the torque output of the gas turbine 6 during steady state operation can be supplemented by the synchronous motor 7.

It is now assumed that the natural gas liquefaction plant has a capacity of 370 t/h. The propane compressor 1 then requires a drive unit capable of producing 45 MW of power, and the mixed refrigerant compressors 2 and 3 require a drive unit capable of producing 71 MW of power. The gas turbines 4 and 6 having identical specifications and an identical power output of 72 MW are used for driving the propane compressor 1 and the mixed refrigerant compressors 2 and 3 by taking into account the power requirement of the mixed refrigerant compressors 2 and 3. By doing so, it is now necessary to prepare only one set of spare parts for major components such as a rotor and bearings as the common back-up for the two identical gas turbines. The synchronous motor 5 associated with the propane compressor 1 thus has a maximum excess power of 27 MW. This excess electric power is supplied to the in-plant electric facilities (electricity users) 14 via the switch S1 and the main power line 9, and reduces the burden on the in-plant power station 8. Alternatively or additionally, the excess electric power may be supplied to the synchronous motor 7 associated with the mixed refrigerant compressors 2 and 3 via the main electric power line 9 and the switch S2, and supplement the torque output of the gas turbine 6.

A natural gas liquefaction plant of this size typically requires approximately 25 MW of electric power for electric power users 14 in the plant, and this amount of electric power can be sufficiently supplied by the excess power generated by the synchronous motor 5 associated with the propane compressor 1. Therefore, the in-plant power station 8 is not required to be capable of producing any more than 10 MW of electric power which is required for starting the propane compressor 1 and the mixed refrigerant compressors 2 and 3.

Figure 2:
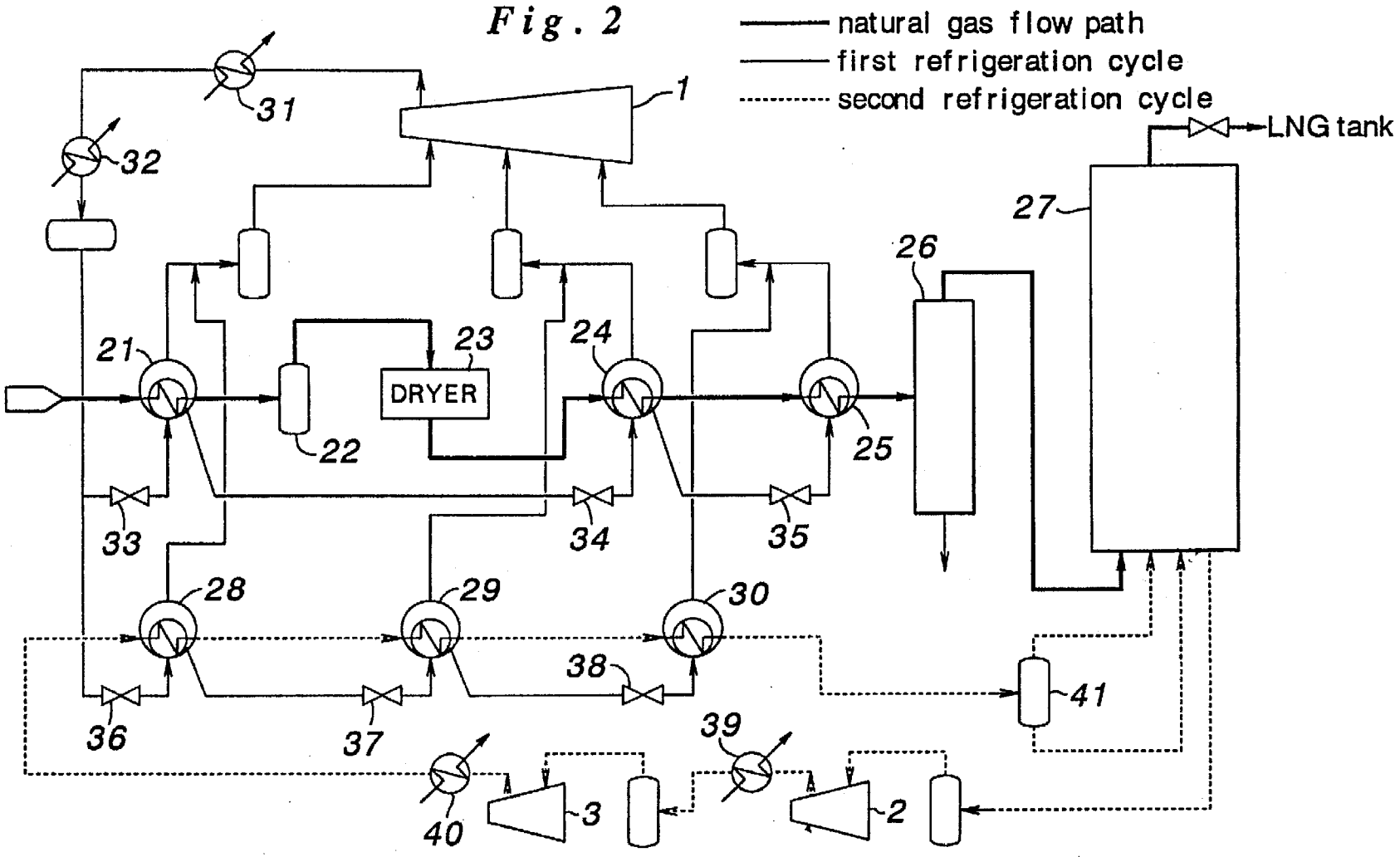
FIG. 2 is a flow chart showing the liquefaction process carried out in the natural gas liquefaction plant.

Now is described a typical natural gas liquefaction plant to which a compressor drive system described above is applied with reference to FIG. 2. The propane refrigerant pressurized by the propane compressor 1 circulates in a first refrigeration loop indicated by fine solid lines in FIG. 2, and the mixed refrigerant pressurized by the mixed refrigerant compressors 2 and 3 circulates in a second refrigeration loop indicated by broken lines in FIG. 2.

After being purified by an amine process or the like and made free from carbon dioxide and hydrogen sulfide, the purified natural gas at the pressure of approximately 50 bar is cooled to 21° C. in a heat exchanger 21 using a high pressure propane (at the pressure of 7.7 bar, and the temperature of 17° C.), and most of the moisture content thereof is condensed and separated in a drum 22. A dryer 23 then further removes moisture from the natural gas to a level below 1 ppm. The thus dried natural gas is cooled to −10° C. in a heat exchanger 24 using a medium pressure propane (at the pressure of 3.2 bar, and the temperature of −13° C.), and then cooled to −30° C. in a heat exchanger 25 using a low pressure propane (at the pressure of 1.3 bar, and the temperature of −37° C). The natural gas is then conducted to a scrub column 26 to separate a heavier fraction therefrom. Finally, the natural gas is cooled to −162° C. in a main heat exchanger 27 using the mixed refrigerant of the second refrigeration loop, and the thus liquefied natural gas is forwarded to an LNG tank.

In the first refrigeration loop indicated by the fine solid lines, the propane refrigerant collected from the heat exchangers 21, 24 and 25 and chillers 28 to 30 is pressurized to 16 bar in the propane compressor 1, and is cooled to 47° C. which is close to the condensation temperature thereof by exchanging heat with cooling water in a desuperheater 31 before it is further cooled and completely condensed by exchanging heat with cooling water in a condenser 32. The condensed propane refrigerant is depressurized to prescribed pressure levels by expansion valves 33 to 38, and is then forwarded to the heat exchangers 21, 24 and 25 and the chillers 28 to 30.

In the second refrigeration loop, the mixed refrigerant which has exchanged heat with the natural gas in the main heat exchanger 27 is compressed by the mixed cooling compressors 2 and 3 in two stages, and is then cooled to 45° C. by cooling water in an intercooler 39 and an aftercooler 40. The thus compressed mixed refrigerant then sequentially exchanges heat in the chillers 28 to 30 with the propane refrigerant which is depressurized in three stages, and finally cooled to −35° C. thereby causing partial condensation thereof.

In the present embodiment, two gas turbines are used for driving the compressors for pressurizing two refrigerants, but the present invention is not limited by this embodiment, and can be applied equally to the cases involving more than two refrigerants and/or using more than two gas turbines. The electric motors serving also as AC generators consisted of synchronous motors, but the present invention is not limited by this embodiment, and the present invention can be substantially equally applied to the cases where induction motors and other motors preferably controlled by inverters are used.

Thus, according to the present invention, it is possible to reduce the fuel consumption by efficient operation of the gas turbines, and a substantial gain can be achieved in reducing the operation cost. Additionally, a substantial gain can be achieved by reducing the investment cost of the plant by allowing the reduction in the capacity of the in-plant power station to be made, combined with a substantial saving in the cost for preparing a stand-by unit of the power station and spare parts of the gas turbines. Furthermore, it is made possible to flexibly take measures against seasonal changes in the power requirement of the compressors and the power output of the gas turbines, and the freedom in the plant design can be enhanced. It is possible to maximize the production capacity of the liquefaction plant for a given make of the gas turbines.

Although the present invention has been described in terms of a specific embodiment, it is possible to modify and alter details thereof without departing from the spirit of the present invention. For instance, the gas turbines used in the present invention are not limited to the single-shaft gas turbines described above, but may consist of gas turbines having double or triple shafts. Also, in the above described embodiment, the entire plant consisted of a single system, but it is possible to arrange a plurality of such systems in parallel, and use other combinations of gas turbines.

What we claim is:

1. A compressor drive system for a natural gas liquefaction plant including:

a pair of gas turbines, each of said gas turbines being installed in a corresponding one of a pair of different refrigeration systems using a propane refrigerant and mixed refrigerant, respectively, each of said refrigerants circulating in a respective independent closed loop, and each of said gas turbines being adapted to drive an associated compressor for pressurizing the corresponding refrigerant, a pair of electric motors, each of said electric motors being associated with a respective one of said gas turbines so as to serve both as an AC generator and as an auxiliary motor for generating a startup torque for the associated gas turbine and the associated compressor, a single frequency converter, switching means for selectively connecting a main power line to either of said motors via said single frequency converter for starting up said gas turbines, at least one of said electric motors being operated as s generator for converting any excess power output of the corresponding gas turbine into electric power when power produced from said corresponding gas turbine is greater than power required by the associated compressor, synchronizing means for synchronizing said at least one electric motor to a prevailing phase and frequency carried by said main electric power line, and means for feeding said electric power converted from said excess power output by said at least one electric motor into said main electric power line.

2. A compressor drive system for a natural gas liquefaction plant according to claim 1, wherein said gas turbines consist of gas turbines of a substantially identical make, and have a capacity sufficient for driving said compressor for one of the two associated refrigeration cycles having a greater power requirement.

3. A compressor drive system for a natural gas liquefaction plant according to claim 1, further comprising a switching arrangement which allows electric power produced from one of said electric motors to be supplied via said main power line to the other electric motor to supplement the power output of the associated gas turbine thereof when the power output of the gas turbine associated with said one electric motor is less than the power required by the associated compressor.

4. A compressor drive system for a natural gas liquefaction plant including at least a first compressor and a second compressor, comprising:

a first gas turbine and a second gas turbine for driving said first and second compressors, respectively;

a first electric motor and a second electric motor connected to output shafts of said first gas turbine and said second gas turbine, respectively, each of said electric motors being capable of serving as an electric motor or as an electric generator;

a synchronous signal detector for synchronizing said electric motors to a prevailing phase and frequency condition of said main electric power line;

first and second switch means for electrically connecting said respective first and second electric motors to a main electric power line when each electric motor is operating either as a generator or, except during startup, as a motor;

a frequency converter; and third and fourth switch means for selectively connecting said frequency converter between each one of said electric motors and said main electric power line during startup.

* * * * *